United States Patent [19]

Shimizu

[11] 4,366,843

[45] Jan. 4, 1983

[54] GUIDE PLATE OF A HEDDLE FRAME

[75] Inventor: Yoichi Shimizu, Izumi, Japan

[73] Assignee: Kabushiki Kaisha Maruyama Seisakusho, Sakaishi, Japan

[21] Appl. No.: 250,176

[22] Filed: Apr. 2, 1981

[30] Foreign Application Priority Data

Jul. 14, 1980 [JP] Japan ..... 55-98050[U]

[51] Int. Cl.[3] ..... D03C 9/06

[52] U.S. Cl. ..... 139/91; 16/342

[58] Field of Search ..... 139/91, 92; 16/319, 16/221, 223, 339, 342, 386

[56] References Cited

U.S. PATENT DOCUMENTS

| | | | |
|---|---|---|---|
| 588,294 | 8/1897 | Riecker | 16/342 |
| 1,847,937 | 3/1932 | Fetters | 16/339 |
| 2,380,124 | 7/1945 | Streuli | 139/88 |
| 2,504,351 | 4/1950 | Ring | 16/342 |
| 3,874,419 | 4/1975 | Wagner | 139/91 |
| 4,091,844 | 5/1978 | Underwood | 139/91 |

*Primary Examiner*—Henry Jaudon

*Attorney, Agent, or Firm*—Oblon, Fisher, Spivak, McClelland & Maier

[57] ABSTRACT

A two part guide plate of a heddle frame is disclosed. One element of the guide plate is fixed to the heddle frame and has a groove into which a movable element is pivotably inserted. The fixed and movable elements are pivotably connected by a connection pin and mate with one another at corresponding fitting parts having sloped contacting surfaces. A projection and depression on the fixed and movable elements cooperate to hold the movable element in an upright position, however sufficient force on the movable element will permit it to be overthrown so that the clearance between the heddle frame and a drawing in machine can be increased.

4 Claims, 9 Drawing Figures

GUIDE PLATE OF A HEDDLE FRAME

BACKGROUND OF THE INVENTION

1. Field of the Invention

This invention relates to a guide plate which guides a heddle frame.

2. Description of the Prior Art

Each upper and lower side beam of a heddle frame is provided with one to three guide plates, which serve to make the opening motion of the heddle frame smoother when the heddle frame is positioned in the body of a loom.

Because the conventional guide plate is made as a single body, and secured to the side beam by way of screw bolts or the like, sometimes the maximum width at the top or bottom of the heddle frame relative to a drawing in machine (specially the underside dimension from the center of the heddle frame) is too narrow, when the heddle frame is attached to the drawing in machine (a machine to pass a warp through a heddle automatically) to perform drawing (pass the yarn through), and the guide plate may obstruct the drawing in action. Therefore with conventional guide plates, the guide plates were removed whenever the heddle frame was attached to the drawing in machine.

Assuming that each heddle frame has three (3) guide plates attached to the upper beam and three to the lower beam, and 16 heddle frames are used, 48 guide plates must be removed, even if taking off the under side guide plates only, and once they are taken off they must be reassembled after passing the warp, resulting in requiring much man-power, as inefficient process.

SUMMARY OF THE INVENTION

In consideration of the inconvenience of the above mentioned conventional heddle frame guides, the present invention has as an object to offer a novel type heddle frame guide plate which permits the passage of warps through the heddles of a heddle frame assembled in a drawing machine without removing the guide plates from the side beam.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

The structure of the first embodiment of this invention is explained hereunder in the reference to FIG. 1 through FIG. 7, in which guide plate 1 consists of fixed side element 2 and movable side element 3.

Figure 2:
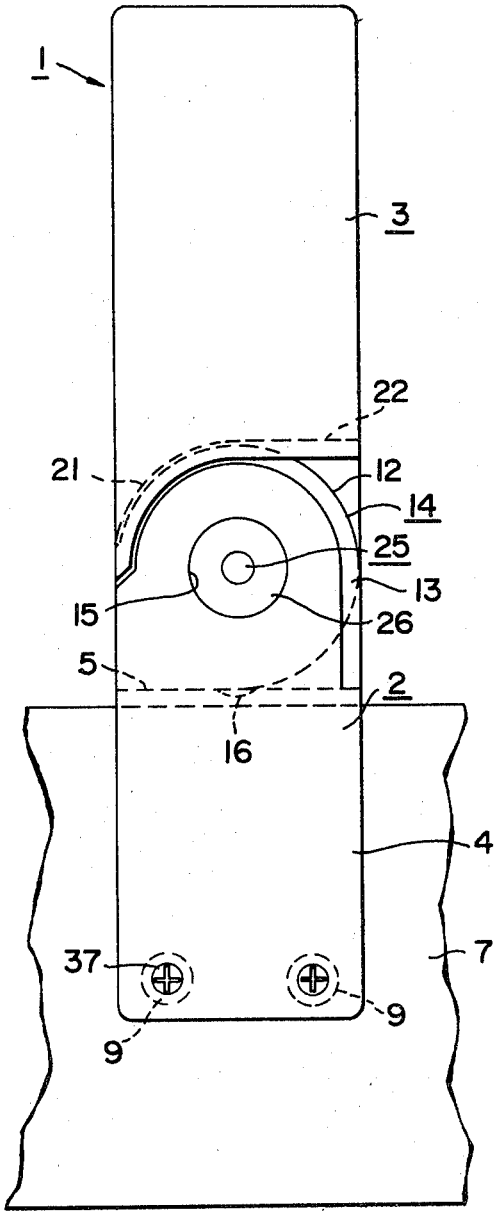
FIG. 2 is an enlarged elevation of a guide plate.
Figure 3:
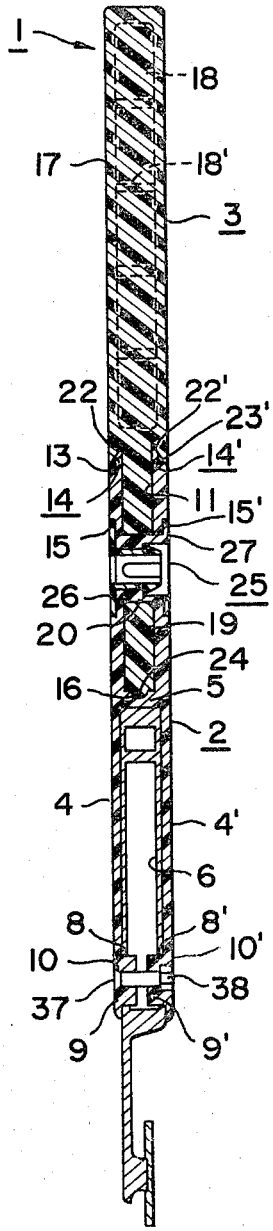
FIG. 3 is a vertical longitudinal sectional view of FIG. 2.

The fixed side element 2 is structured as shown in FIG. 2 and FIG. 3. A connecting part 5 connecting both clipping pieces 4 and 4' is formed in the center of the fixed side element 2, and a side beam fitting groove 6 is formed in the side beam 7 of the heddle frame adjacent the underside of the connecting part 5. In both sides of the lower ends of clipping pieces 4 and 4', are formed mating parts 9 and 9', which fit through holes 8, 8' (see FIG. 3) of the side beam 7 of the heddle frame A so as to project into the fitting groove 6 of the side beam, with screw holes 10, 10' for each mating part 9 and 9'. The upper side of both clipping pieces 4 and 4' is formed with a joining groove 11, the upper ends of which are formed with circular arc portions 12, and which is also formed with fitting parts 14 and 14' with sloped surfaces 13 having about a 30° slope angle and extending from the ends of the circular arc portions 12 outwardly and downwardly toward the upper side of the connecting part 5. Circular joining holes 15 and 15' are formed at the center of said circular arc portions 12 of the clipping pieces 4 and 4', and a circular arc fixing recess 16 is formed in the center of the upper surface of the said connecting part 5.

Further, the fixed side element 2 can be made strong and quiet by using wear resistant plastic materials such as "Durakon," (polyacetal resin) etc.

The movable side element 3 is also constructed as shown in FIG. 2 and FIG. 3. The upper part 17 has the same width as that of the clipping pieces 4 and 4' and is hollow, but with a number of vertically extending ribs 18 and horizontal stiffner cross ribs 18'. The lower end of the element is formed with a single body connecting part 19 which is formed thinner than the remainder of the movable element so that it can be fit in the joining groove 11. The connecting part 19 includes an inserting hole 20, and a circular arc portion 21, having hole 20 as a center, is formed in the lower end. Fitting grooves 22 and 22', which fit with the fitting parts 14 and 14' extend on both sides of the connection part 19 from upper end of circular arc portion 21 to the opposite side walls of the upper portion 17 and divide the connection part 19 from the upper portion 17. The fitting grooves 22, 22' are formed in circular arc form adjacent circular arc portion 21. The fitting grooves 22 and 22' are provided with 30° sloped surfaces 23 which mate with the sloped surfaces 13 of the fitting parts 14 and 14'. At the lower center of the connecting part 19, circular arc projection 24 projects to fit with the fixing recess 16.

Figure 4:
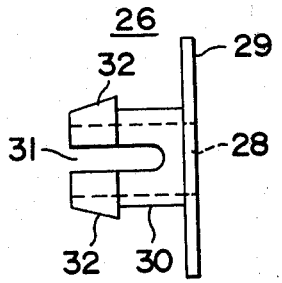
FIG. 4 is a side view of the male part of the connection pin.
Figure 5:
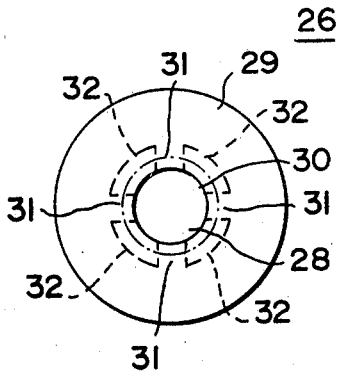
FIG. 5 is an elevation of the male part of FIG. 4.
Figure 6:
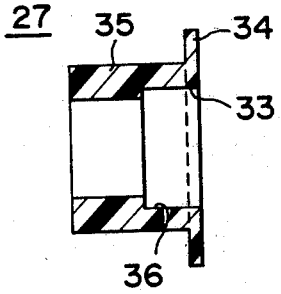
FIG. 6 is a longitudinal sectional view indicating the female part of the connecting pin.
Figure 7:
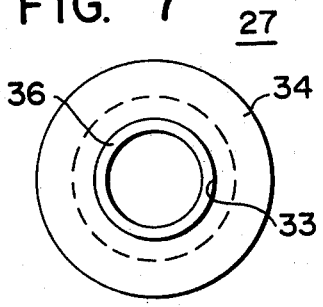
FIG. 7 is the elevation of the female part of FIG. 6.

Further, the movable side element 3 can be made sufficiently strong and noise preventive by use of wear resistant plastic material such as Durakon, as in the case of fixed side element 2. In guide plate 1, the connection part 19 of movable side element 3 engages with the joining groove 11 of the fixed side element 2, and they are joined by inserting a connection pin 25 through joining holes 15 and 15', and connecting hole 20. The connection pin 25 is constructed of a male part 26 and a female part 27 formed of wear resistant plastic material such as Durakon. The male part 26 is made with a hollow cylindrical projection 30 formed on a side of a flange 29 having through hole 28 in the center, as shown in FIG. 4 and FIG. 5. Four slits 31 are formed in the projection 30, extending parallel with the cylinder axis, and circumferentially separated by 90°. Bosses 32, which are triangular in section are formed between each slit 31 at the end of the projection opposite the end for the flange. The female part 27 is formed by a cylindrically projected hollow receptacle 35 attached to one side of a flange 34 having through hole 33 as shown in FIG. 6 and FIG. 7. A larger diameter cylindrical joining part 36 of the through hole 33 is formed in the flange side inner surface of the projected receptacle.

When female part 27, constructed as above, is fit in the through hole 20 through one joining hole 15, and male part 26 is fitted in the projected part 35 of the female part 27 by insertion through joining hole 15', the bosses 32 of the male part 26 are contracted by partially closing slits 31, but return to their original form when the bosses reach joining part 36. The bosses 32 are thus engaged by the stepped portion of joining part 36 so that the male part is permanently joined to the female part. In this condition, fixed side element 2 and movable side element 3 of the guide plate 1 are joined together, and under normal conditions, they are linearly connected as shown in FIG. 2 and FIG. 3. As such, circular arc projection 24 of the movable side element 3 fits in the fitting recess 16 of fixed side element 2, and the fitting parts 14 and 14' of fixed side element 2 are engaged in the fitting grooves 22 and 22' of the movable side element 3, causing the movable side element 3 to remain in an upright condition due to friction among the parts.

To attach the guide plates 1 to the side beam 7, the bottom end of the side beam fitting groove 6 is first opened and clipping pieces 4 and 4' are placed at predetermined positions on the side beam 7. Mating parts 9, and 9', are then fitted in the fitting holes 8 and bolts 37 are passed from one screw hole 10 to the other screw hole 10', and are fixed by fastening nuts 38.

Figure 1:
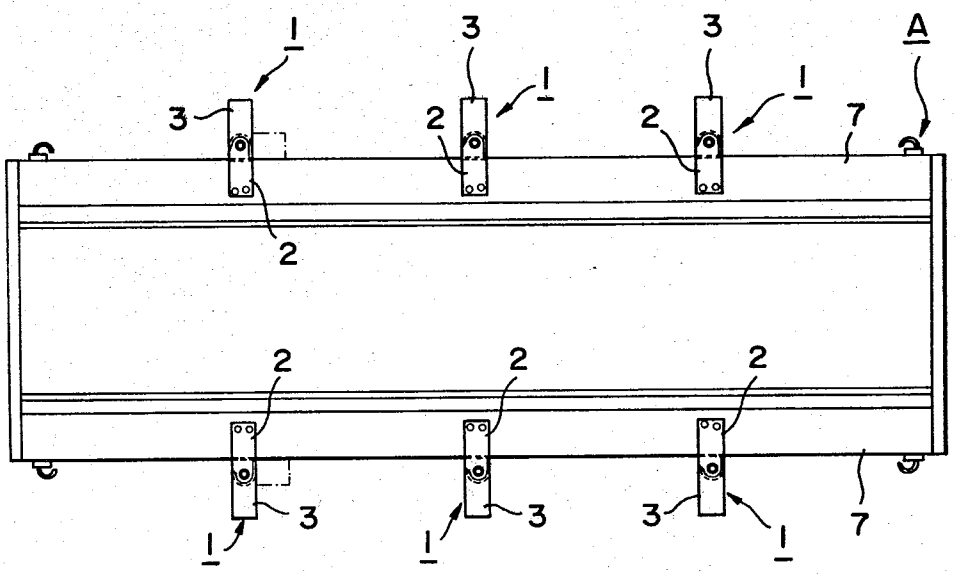
FIG. 1 is an elevational view showing several guide plates attached to a heddle frame.

The invention described above is used in the case of attaching or removing a heddle frame to or from a drawing in machine (not indicated in the drawings) by rotating the movable side element 3 around the connecting pin 25 as shown by the broken line in FIG. 1, to reduce the distance from the center of the heddle frame to the edge point of the lower guide plate.

Before overthrowing the movable side frame 3, the circular arc projection 24 fitted in the fixing recess 16 so that it resists the overthrow action; however, because of circular arc form of the projection 24, increased force on the movable side element 3 can overpower the resistance, to cause overthrowing.

Figure 8:
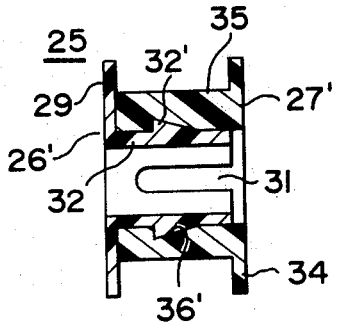
FIG. 8 is a longitudinal sectional view of the second embodiment of the connection pin.

The second embodiment of this invention is now described with reference to FIG. 8, which shows a variation of connection pin 25. The male part 26' is formed with four triangular bosses 32', as in the earlier embodiment, but located at the mid-point of the projection part 30. The female part 27' is formed with a triangular section form corresponding to the bosses of part 36', at its center mid point.

The connection pin of the first and second embodiment is used for the connection of the fixed side element 2 to the movable side element 3 for easy connection by simply fitting the male part to the female part, and except for this consideration, any other type of connection pin structure can be used.

Figure 9:
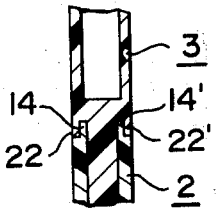
FIG. 9 is a longitudinal sectional view indicating only the essential part of a third embodiment.

The third embodiment of this invention is described in FIG. 9. In this embodiment, fitting parts 14 and 14' of fixed side element 2 are formed with a square section projection instead of sloped surface as in the case of the first embodiment, and the fitting grooves 22, 22' of movable side element 3 are formed with corresponding square grooves. Other features of the fitting parts 14 and 14' and fitting grooves 22 and 22' are the same as in the first embodiment.

It was explained in reference to the first embodiment that fixed side element 2 is fixed to the side beam 7 by fitting the mating part 9 in the through hole 8 formed in the side beam 7. This structure was chosen based upon the construction of the side beam 7; however, other structures such as to position side beam 7 in the side beam fixing groove 6 and to fix the lower end of the clipping pieces 4 and 4' with screw bolts may be adopted, depending on the structure of the side beam 7.

The guide plate to be attached to the upper side beam 7 can be of the single body fixed style as conventionally used.

This invention is constructed and functions as described above, which allows one to make the height of the guide plate 1 lower by overthrowing the movable side element 3 so that it becomes parallel with the side beam 7. Because of the structure of connecting the fixed side element 2 with the movable side element 3 by a connection pin 25, the necessity of removing the guide plate from the side beam when attaching or removing heddle frames to or from a drawing in machine is eliminated, even in the case where the maximum width dimension of the top and bottom of the heddle frame is restricted as in the case of drawing in machine, and results in the improvement of operating conditions.

Because of the structure that the fitting parts 14 and 14' of fixed side element 2 are formed to extend from the circular arc to the clipping piece 4, corresponding side element 3 is prevented by friction from falling down. Further, the feature of fitting the fitting parts 14 and 14' into the fitting grooves 22 and 22' formed in the movable side element 3, prevents the movable side element 3 from falling down during an opening operation, because of the frictional force between both parts.

The sloped faces of fitting parts 14 and 14', and fitting grooves 22 and 22', increases their contacting friction surfaces which permits them to be better able to prevent the falling down of the movable side element 3.

Further the fixing recess 16 formed in the connecting part 5 of the fixed side element 2, and the circular arc projection 24 fittable within the fixing recess and formed in the movable side element 3, further ensure the prevention of the falling down of movable side element 3.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A guide plate of a heddle frame, comprising:

a fixed element including lower clipping pieces adapted to fit on and be fixed to a side beam of a heddle frame, said fixed element further including a connecting part connecting said clipping pieces together, said clipping pieces extending upward to terminate in at least one arc, and a fitting part extending from one wall to the other of each said arc;

a movable element including a connection part including a fitting part matable with said fitting part of said fixed element; and a connection pin pivotally connecting said fixed and movable elements;

whereby said movable element is pivotable about said fixed element.

2. The guide plate of claim 1 wherein said fitting parts of said fixed and movable elements have corresponding transversely sloped faces.

3. The guide plate of claim 1 wherein said connection pin comprises:

a male part having a first hollow cylindrical projection, a flange at one end of said projection, a plurality of slits at the other end of said projection, and a boss between each of said slits on said other end, said bosses being triangular in section; and a female part having a second hollow cylindrical projection whose inner diameter corresponds to the outer diameter of said first cylindrical projection, a flange at one end of said second projection, and a joining part in said second projection, said joining part being adapted to mate with said bosses.

4. The guide plate of claim 1 wherein said connecting part of said fixed element includes a fixing recess and wherein said connection part of said movable element includes a curved projection matable with said fixing recess.

* * * * *